US010220490B2

(12) United States Patent
Wu

(10) Patent No.: US 10,220,490 B2
(45) Date of Patent: Mar. 5, 2019

(54) KNIFE SHARPENER

(71) Applicant: Shih-Piao Wu, Changhua (TW)

(72) Inventor: Shih-Piao Wu, Changhua (TW)

(73) Assignee: Jiin Haur Industrial Co. Ltd., Changhua (TW)

( * ) Notice: Subject to any disclaimer, the term of this patent is extended or adjusted under 35 U.S.C. 154(b) by 185 days.

(21) Appl. No.: 15/296,391

(22) Filed: Oct. 18, 2016

(65) Prior Publication Data

US 2018/0104796 A1 Apr. 19, 2018

(51) Int. Cl.
*B24D 15/08* (2006.01)
*B24B 3/54* (2006.01)

(52) U.S. Cl.
CPC ..... *B24D 15/08* (2013.01); *B24D 15/081* (2013.01); *B24B 3/54* (2013.01)

(58) Field of Classification Search
CPC ..... B24B 3/52; B24B 3/54; B24D 15/063; B24D 15/065; B24D 15/08; B24D 15/081
See application file for complete search history.

(56) References Cited

U.S. PATENT DOCUMENTS 7,153,200 B1 * 12/2006 Wu ..... B24B 41/00 451/344
D541,615 S * 5/2007 Wu ..... D8/90
D618,532 S * 6/2010 Wu ..... D8/71
D664,422 S * 7/2012 Wu ..... D8/367
8,221,199 B2 * 7/2012 Smith ..... B24B 3/54 451/461
D666,082 S * 8/2012 Wu ..... D8/367
D673,439 S * 1/2013 Wu ..... D8/93
2008/0274675 A1 * 11/2008 Chen ..... B24B 3/52 451/65
2009/0275272 A1 * 11/2009 Bonapace ..... B24D 15/082 451/321
2009/0325473 A1 * 12/2009 Smith ..... B24D 15/08 451/555
2012/0264358 A1 * 10/2012 Wu ..... B24D 15/065 451/344
2013/0231033 A1 * 9/2013 Wu ..... B24D 15/065 451/552
2014/0038504 A1 * 2/2014 Cozzini ..... B24D 15/081 451/555
2015/0258651 A1 * 9/2015 Elek ..... B24B 3/54 451/45
2015/0273663 A1 * 10/2015 Wu ..... B24D 15/065 451/555
2016/0207172 A1 * 7/2016 Weiner ..... B24B 3/54
2016/0368116 A1 * 12/2016 Wu ..... B24D 15/081

* cited by examiner

*Primary Examiner* — Timothy V Eley
(74) *Attorney, Agent, or Firm* — Che-Yang Chen; Law Offices of Scott Warmuth

(57) ABSTRACT

A knife sharpener may comprise a main body, and a suction cup formed on a lower surface thereof is operated by an operating handle. By cooperating the main body with the operating handle and the suction cup, the knife sharpener is configured to easily adhere to a flat surface, which avoids a damage formed on the flat surface during the sharpening process. Moreover, since the knife sharpener comprises various sharpening units, it can be used to sharpen different kinds of knives, even a scissors comprising a pair of blades, which greatly enhances the practicability thereof.

9 Claims, 8 Drawing Sheets

KNIFE SHARPENER

FIELD OF THE INVENTION

The present invention relates to a knife sharpener and more particularly to a knife sharpener that can used for different kinds of knives.

BACKGROUND OF THE INVENTION

Generally, referring to FIG. 8, a conventional knife sharpener comprises a main body (70), a suction cup (71), an operating handle (72) and an upper cover (73). The main body (70) has a through hole penetrating through a central portion thereof, the suction cup (71) is configured to create a vacuum zone thus adhering to a flat surface. A rod penetrating through the through hole of the main body (70) is pivotally connected to the operating handle (72). The operating handle (72) comprises a protruding portion (721) located at a pivot point between the rod and the operating handle (72), and a lever (722) is formed at another end of the operating handle (72). A lid (73) covers on a top portion of the main body (70), and a standing plate protruding from a top surface of the lid (73) has a V-shaped notch which is configured to receive a sharpening stone (731) thereon. In actual application, a user can hold the suction cup (71) against a flat surface, and then pulls the operating handle (72) to bear the protruding column (721) against the main body (70) such that a vacuum zone is formed between the flat surface and the suction cup (71), and also the main body (70) is configured to press an outer edge of the suction cup (71) thus allowing the suction cup (71) to firmly adhere to the flat surface. As a result, a knife is configured to be moved forth and back on the sharpening stone (731) of the knife sharpener to achieve sharpening effect.

However, the conventional knife sharpener has following disadvantages: since the conventional knife sharpener can only provide a fixed sharpening angle, it cannot be widely used in all kinds of knives because different knives may have different specific sharpening angles, which reduces its practicability. Therefore, there remains a need for a new and improved design for a knife sharpener to overcome the problems presented above.

SUMMARY OF THE INVENTION

The present invention provides a knife sharpener which comprises a main body, and a suction cup formed on a lower surface thereof is operated by an operating handle. A lever is connected with an upper surface of the suction cup at one end, and penetrates through the main body to pivotally connect to the operating handle at another end such that by moving the operating handle to bear against an eccentric portion of the main body, the suction cup is pulled and creates a vacuum zone in a working surface thereof. A spring is located between the main body and the suction cup, and an upper surface of the main body comprises at least a platform, a first sharpening slot and a second sharpening slot. A flat sharpening stone is formed at an upper surface of the platform, and a first sharpening unit is settled inside the first sharpening slot while a second sharpening unit is settled inside the second sharpening slot. A third sharpening slot and a fourth sharpening slot are respectively formed at two lateral sides of the main body, and a third sharpening unit is settled inside the third sharpening slot while a fourth sharpening unit is settled inside the fourth sharpening slot. Wherein the different sharpening units in the sharpening slots are respectively configured to provide various sharpening angles for different kinds of knives.

Comparing with conventional knife sharpener, the present invention is advantageous because the knife sharpener comprises various sharpening units, it can be used to sharp different kinds of knives, even a scissors comprising a pair of blades, which greatly enhances the practicability thereof.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
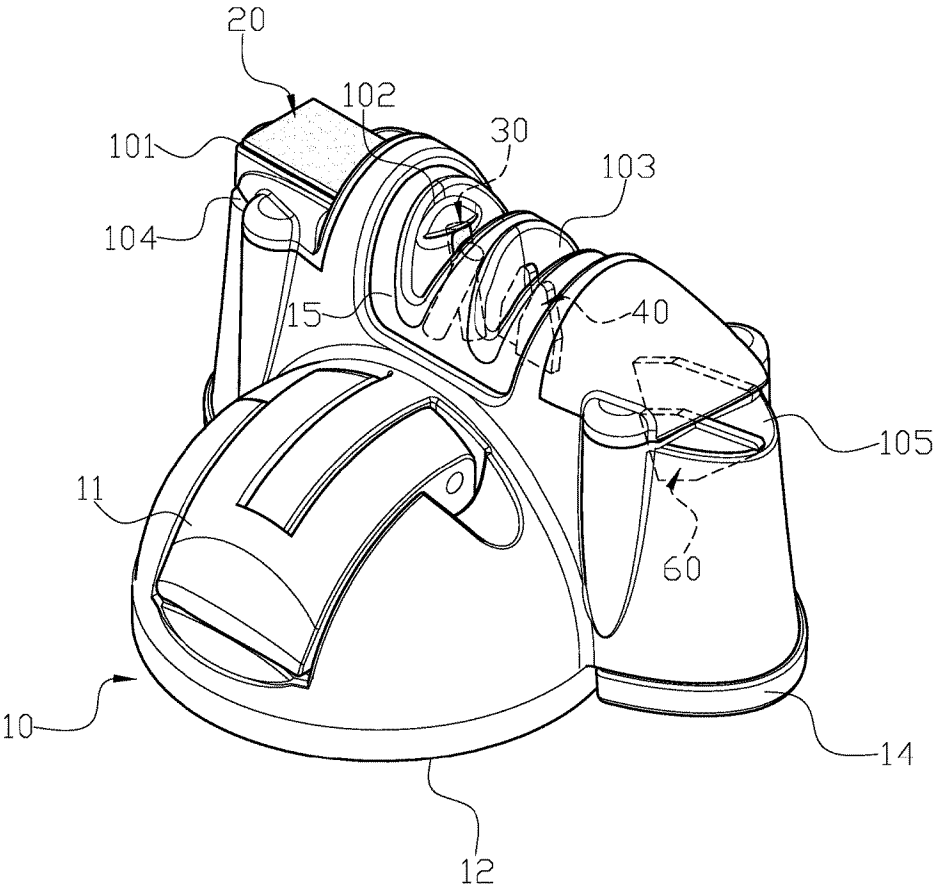
FIG. 1 is a three-dimensional assembly view of a knife sharpener in the present invention.
Figure 2:
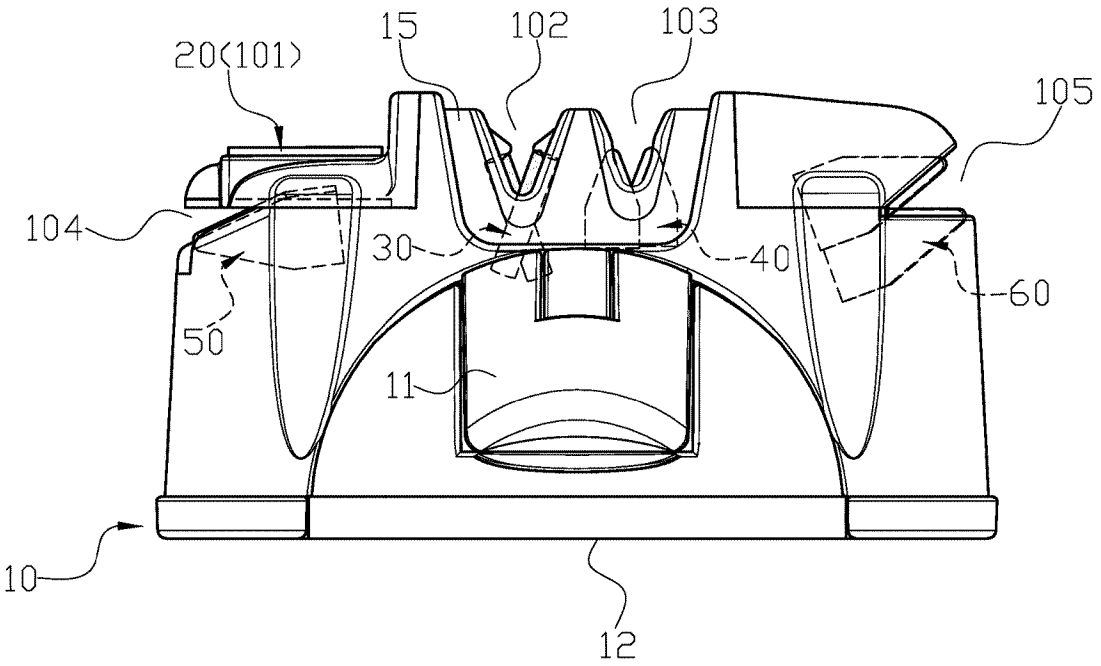
FIG. 2 is a two-dimensional view of the knife sharpener in the present invention.
Figure 3:
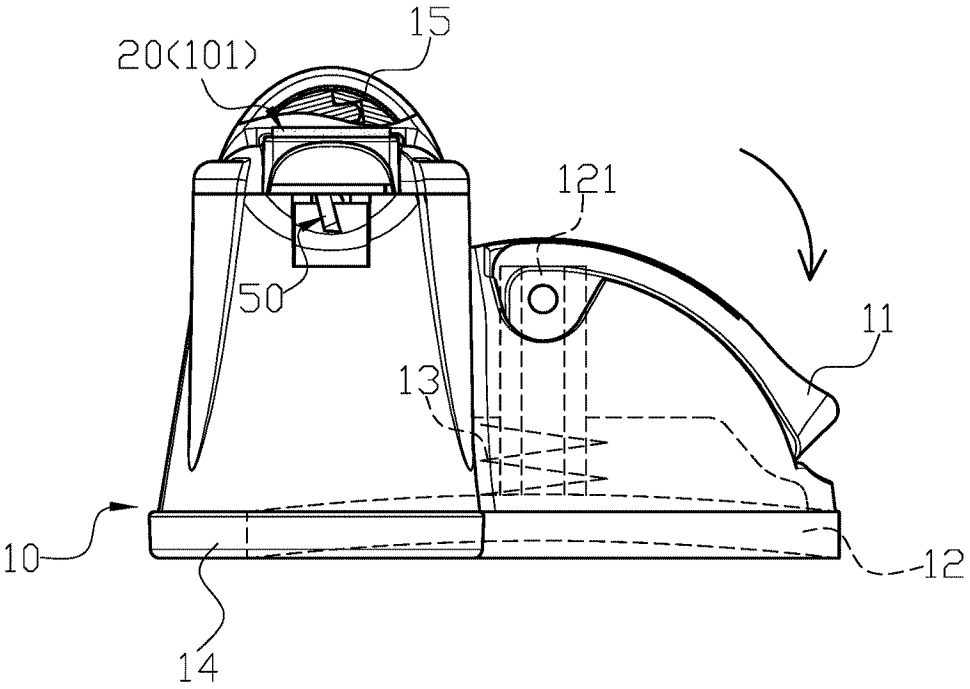
FIG. 3 is a schematic view illustrating the knife sharpener of the present invention is adhered to a surface.

In order to further understand the goal, characteristics and effect of the present invention, a number of embodiments along with the drawings are illustrated as following:

Referring to FIGS. 1 to 3, the present invention provides a knife sharpener which comprises a main body (10), and a suction cup (12) formed on a lower surface thereof is operated by an operating handle (11). A lever (121) is connected with an upper surface of the suction cup (12) at one end, and penetrates through the main body (10) to pivotally connect to the operating handle (11) at another end such that by moving the operating handle (11) to bear against an eccentric portion of the main body (10), the suction cup (12) is pulled and creates a vacuum zone in a working surface thereof. A spring (13) is located between the main body (10) and the suction cup (12), and an upper surface of the main body (10) comprises at least a platform (101), a first sharpening slot (102) and a second sharpening slot (103). A flat sharpening stone (20) is formed at an upper surface of the platform (101), and a first sharpening unit (30) is settled inside the first sharpening slot (102) while a second sharpening unit (40) is settled inside the second sharpening slot (103). A third sharpening slot (104) and a fourth sharpening slot (105) are respectively formed at two lateral sides of the main body (10), and a third sharpening unit (50) is settled inside the third sharpening slot (104) while a fourth sharpening unit (60) is settled inside the fourth sharpening slot (105). Wherein the different sharpening units in the sharpening slots are respectively configured to provide various sharpening angles for different kinds of knives.

In one embodiment, a bottom portion of the main body (10) has a round shell and an elongated shell which are located side by side, and wherein the round shell is configured to install the suction cup (12) therein, and the elongated shell further comprises a semicircular recessed portion and a remaining portion which are respectively configured to evade the suction cup (12) and attach a pad (14) thereon.

In another embodiment, the main body (10) has a protecting cap (15) covering outer peripheries of the first sharpening slot (102) and the second sharpening slot (103) and configured to protect a blade of a knife to directly contact and damage the main body (10) during the sharpening process.

In still another embodiment, the first sharpening slot (102) and the second sharpening slot (103) are formed in a V-shape and facing up.

In a further embodiment, the third sharpening slot (104) formed at the first lateral side of the main body (10) has a horizontal top and a tilted bottom.

In still a further embodiment, the fourth sharpening slot (105) formed at the second lateral side of the main body (10) comprises a tilted top and a horizontal bottom.

In yet a further embodiment, the first sharpening unit (30) has two sharpening bars which are crossed and overlapped.

In a particular embodiment, each of the second sharpening unit (40) and the fourth sharpening unit (60) comprises two sharpening blades which are crossed and overlapped.

Figure 4:
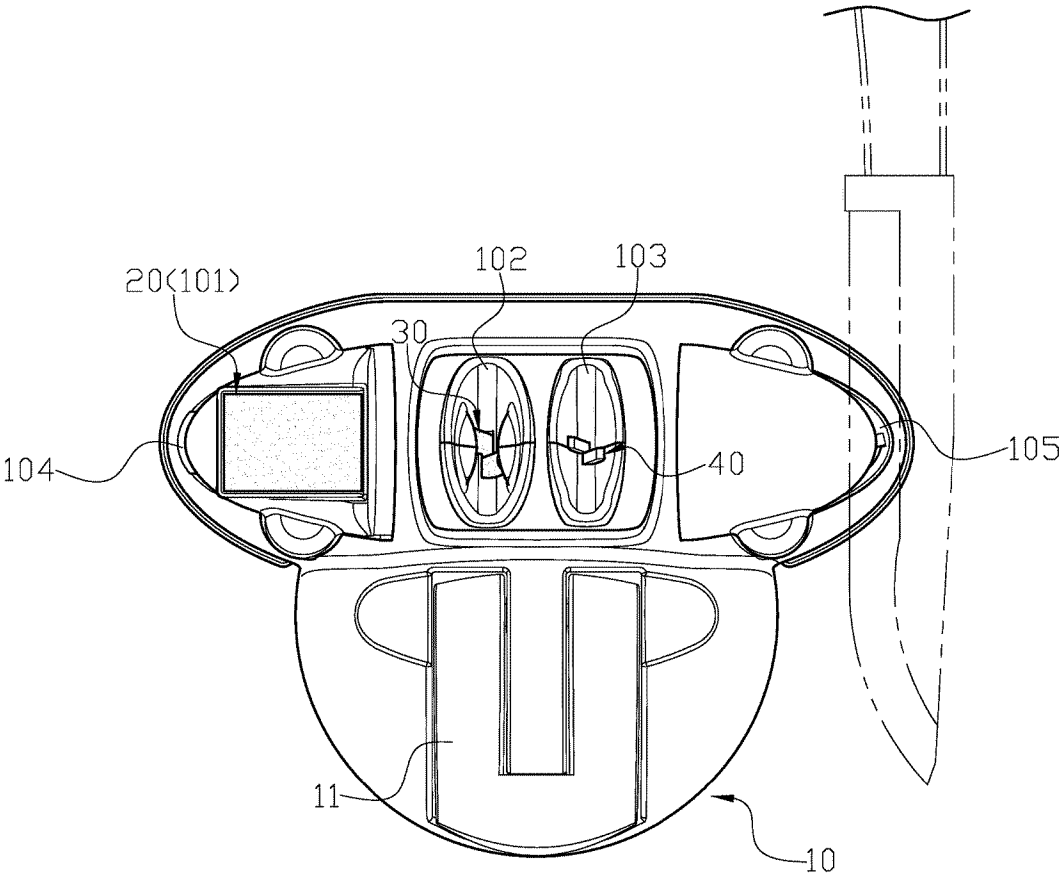
FIG. 4 is a schematic view illustrating the knife sharpener of the present invention when in use.
Figure 5:
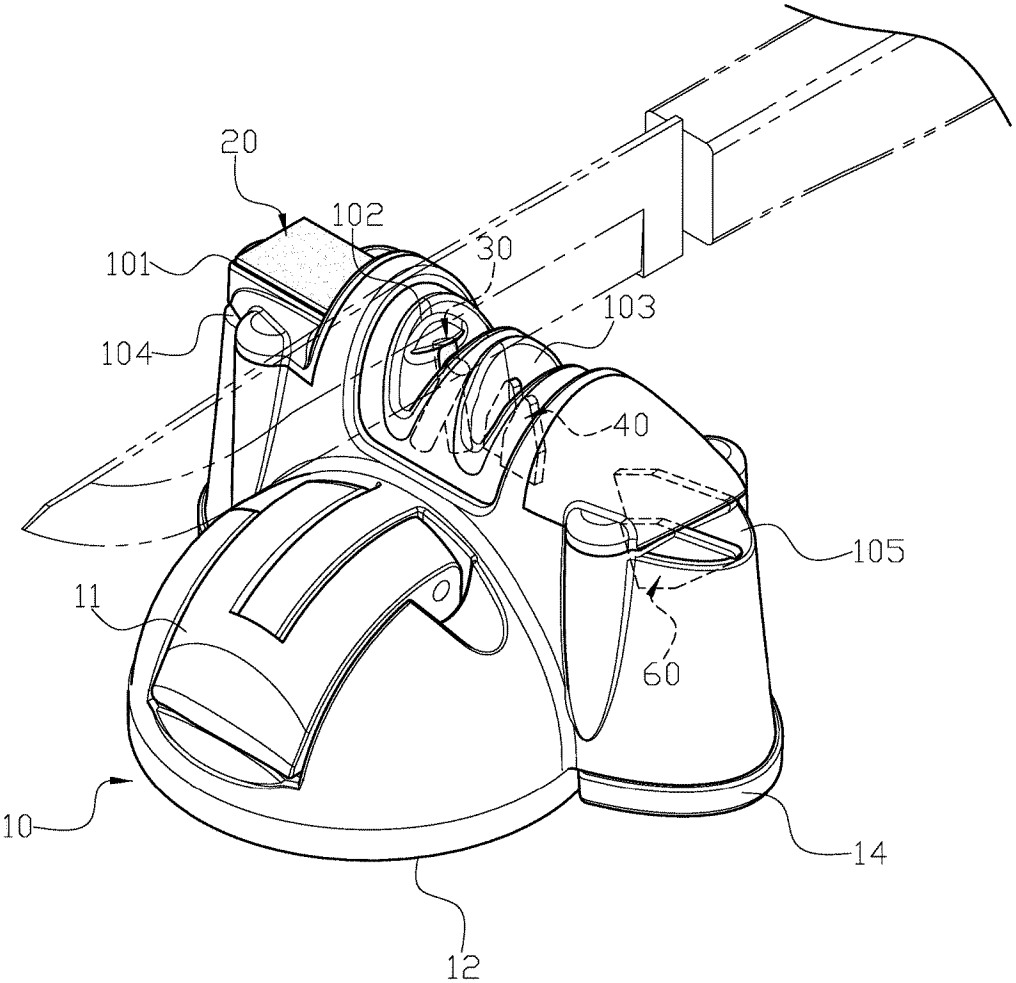
FIG. 5 is the second schematic view illustrating the knife sharpener of the present invention when in use.
Figure 6:
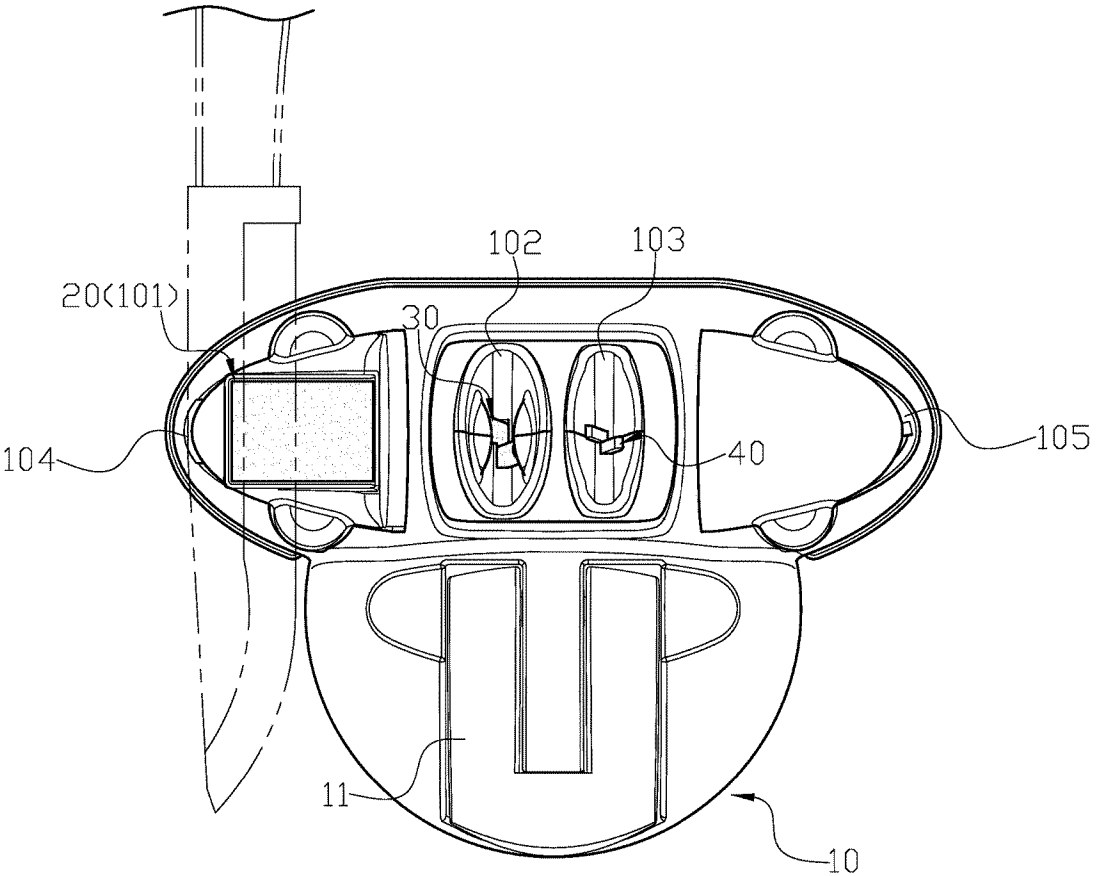
FIG. 6 is the third schematic view illustrating the knife sharpener of the present invention when in use.
Figure 7:
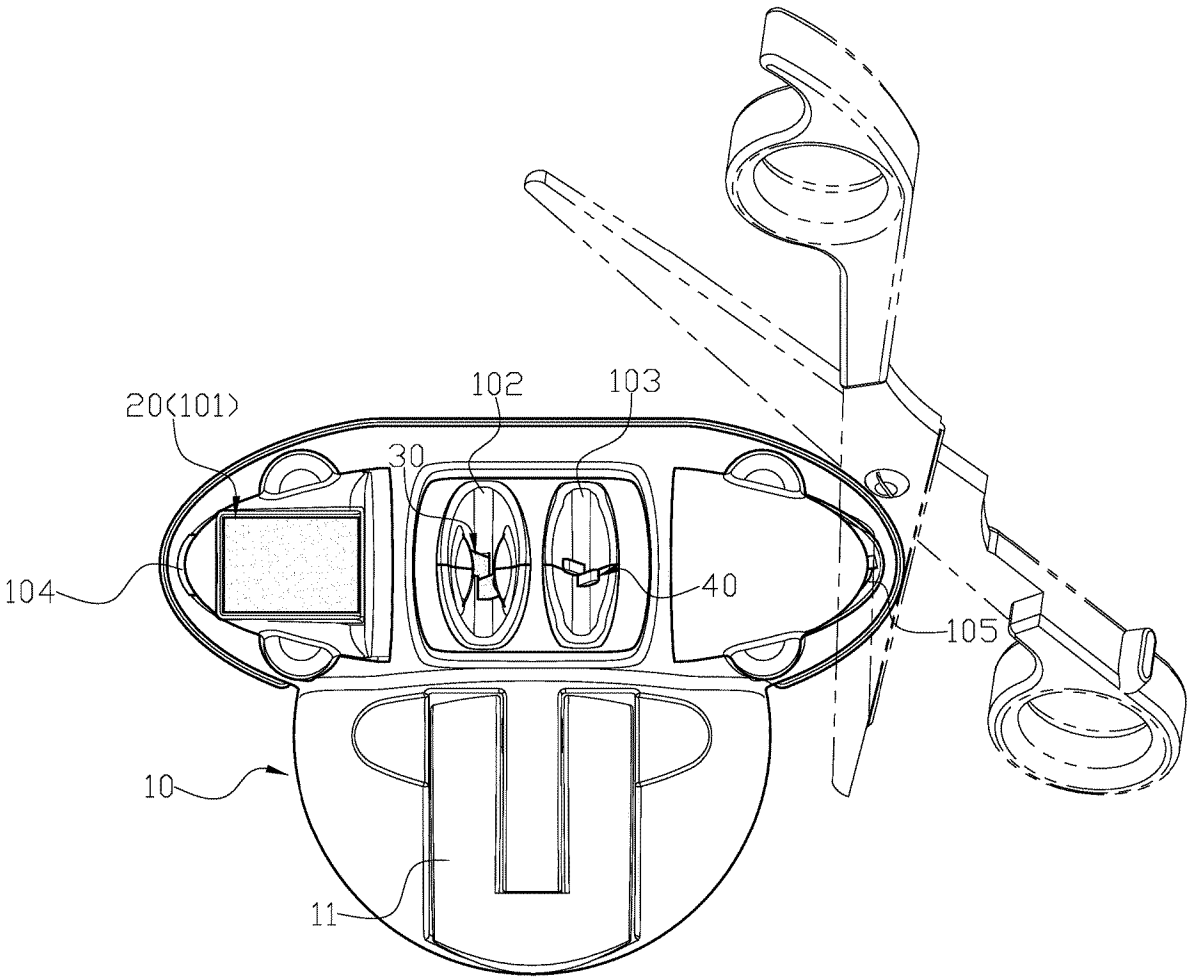
FIG. 7 is the fourth schematic view illustrating the knife sharpener of the present invention when in use.
Figure 8:
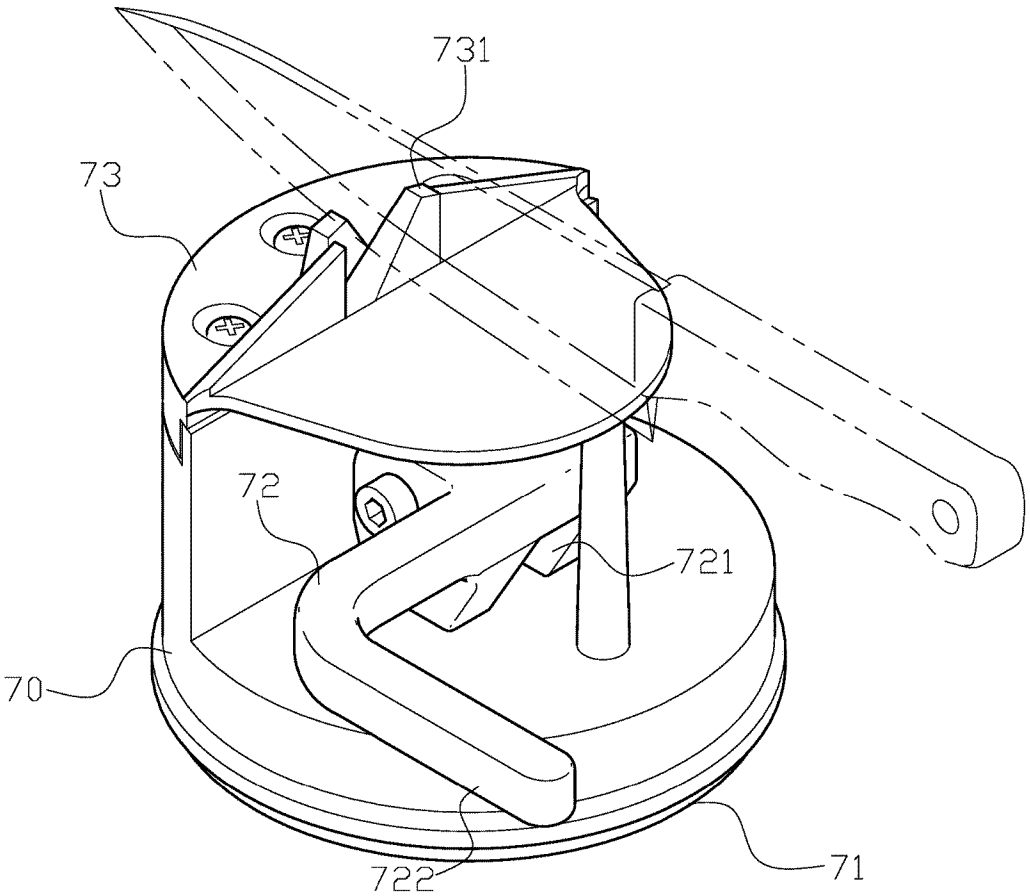
FIG. 8 PRIOR ART
FIG. 8 is a prior art.

In actual application, by cooperating the main body (10) with the operating handle (11) and the suction cup (12), the knife sharpener is configured to easily adhere to a flat surface, which avoids a damage formed on the flat surface during the sharpening process. Moreover, since the knife sharpener comprises various sharpening units, it can be used to sharp different kinds of knives (as shown in FIGS. 4 to 6), even a scissors comprising a pair of blades (as shown in FIG. 7), which greatly enhances the practicability thereof.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A knife sharpener comprising:

a main body having a pair of lateral openings formed on each side of the main body and a suction cup, which is formed on a lower surface thereof, operated by an operating handle, and a lever connected with an upper surface of the suction cup at one end, and penetrating through the main body to pivotally connect to the operating handle at another end such that by moving the operating handle to bear against an eccentric portion of the main body, the suction cup being pulled to create a vacuum zone; a spring located between the main body and the suction cup, and an upper surface of the main body comprising at least a platform, at least a first sharpening slot and at least a second sharpening slot, and a flat sharpening stone formed at an upper surface of the platform, and a first sharpening unit settled inside the first sharpening slot while a second sharpening unit settled inside the second sharpening slot; a third sharpening slot and a fourth sharpening slot respectively formed at each of the lateral openings of the main body, and a third sharpening unit settled inside the third sharpening slot while a fourth sharpening unit settled inside the fourth sharpening slot; wherein the different sharpening units in the sharpening slots are respectively configured to provide various sharpening angles for different kinds of knives.

2. The knife sharpener of claim 1, wherein a bottom portion of the main body has a round shell and an elongated shell which are located side by side, and the round shell is configured to install the suction cup therein, and the elongated shell further comprises a semicircular recessed portion and a remaining portion which are respectively configured to evade the suction cup and attach a pad thereon.

3. The knife sharpener of claim 1, wherein the main body has a protecting cap covering outer peripheries of the first sharpening slot and the second sharpening slot.

4. The knife sharpener of claim 3, wherein the protecting cap is made of metal.

5. The knife sharpener of claim 1, wherein the first sharpening slot and the second sharpening slot are formed in a V-shape and facing up.

6. The knife sharpener of claim 1, wherein the third sharpening slot has a horizontal top and a tilted bottom.

7. The knife sharpener of claim 1, wherein the fourth sharpening slot comprises a tilted top and a horizontal bottom.

8. The knife sharpener of claim 1, wherein the first sharpening unit has two sharpening bars which are crossed and overlapped.

9. The knife sharpener of claim 1, wherein each of the second sharpening unit and the fourth sharpening unit comprises two sharpening blades which are crossed and overlapped.

* * * * *